US007306706B2

(12) United States Patent
Robinson et al.

(10) Patent No.: US 7,306,706 B2
(45) Date of Patent: Dec. 11, 2007

(54) METHOD AND APPARATUS FOR STRIPPING ELECTRODEPOSITED METAL SHEETS FROM PERMANENT CATHODES

(75) Inventors: Victor Robinson, Port Sydney (CA); Philip Donaldson, Porcupine (CA)

(73) Assignee: Falconbridge Limited, Ontario (CA)

( * ) Notice: Subject to any disclaimer, the term of this patent is extended or adjusted under 35 U.S.C. 154(b) by 292 days.

(21) Appl. No.: 10/497,296

(22) PCT Filed: Jan. 21, 2004

(86) PCT No.: PCT/CA2004/000074

§ 371 (c)(1),
(2), (4) Date: May 27, 2004

(87) PCT Pub. No.: WO2005/071142

PCT Pub. Date: Aug. 4, 2005

(65) Prior Publication Data

US 2005/0155867 A1 Jul. 21, 2005

(51) Int. Cl.
*C25B 9/00* (2006.01)
*C25D 1/00* (2006.01)

(52) U.S. Cl. ..... 204/279; 204/281

(58) Field of Classification Search ..... 204/198, 204/208, 281, 279, 255
See application file for complete search history.

(56) References Cited

U.S. PATENT DOCUMENTS

| | | | | |
|---|---|---|---|---|
| 3,807,020 A | | 4/1974 | Van Raevels et al. | 29/762 |
| 3,883,403 A | | 5/1975 | Ettel et al. | 205/76 |
| 3,953,312 A | | 4/1976 | Kikkawa et al. | 204/198 |
| 4,039,418 A | | 8/1977 | Kawakami et al. | |
| 4,049,527 A | | 9/1977 | Harimoto et al. | |
| 4,131,531 A | | 12/1978 | Kaneko et al. | 204/208 |
| 4,209,379 A | | 6/1980 | Freeman et al. | 204/198 |
| 4,417,953 A | | 11/1983 | Viellefont et al. | 205/76 |
| 4,479,854 A | * | 10/1984 | Willans et al. | 205/76 |
| 4,566,951 A | | 1/1986 | Norberg et al. | 134/15 |
| 5,149,410 A | * | 9/1992 | Robinson et al. | 204/199 |

FOREIGN PATENT DOCUMENTS

| | | |
|---|---|---|
| EP | 0 482 258 B1 | 10/1990 |
| EP | 0 428 258 | 5/1991 |
| WO | WO 02/097170 A2 | 12/2002 |

* cited by examiner

*Primary Examiner*—Nam Nguyen
*Assistant Examiner*—Luan V. Van
(74) *Attorney, Agent, or Firm*—Wells St. John P.S.

(57) ABSTRACT

A method and apparatus for stripping electro-deposited metal sheets from a cathode blank. The blank has opposite faces, upstream and downstream ends. At least one sheet is provided on at least one blank face to define upstream and downstream edges. The apparatus comprises a stripping assembly for stripping the electro-deposited metal sheets from the cathode blank, a discharge assembly and a metal sheet out-feed assembly. The discharge assembly is positioned downstream of the stripping assembly and includes opposite guide rollers adapted to engage the metal sheet exiting the stripping assembly. The metal sheet out-feed assembly is positioned downstream the discharge assembly for receiving the metal sheet. When the metal sheet has been stripped from the cathode blank, the guide rollers controllably feed the metal sheet to the out-feed assembly. The method comprises stripping the metal sheets from the cathode and controllably discharging the stripped sheets to an out-feed assembly.

72 Claims, 12 Drawing Sheets

METHOD AND APPARATUS FOR STRIPPING ELECTRODEPOSITED METAL SHEETS FROM PERMANENT CATHODES

CROSS REFERENCE TO RELATED APPLICATION

This application is a 35 U.S.C. §371 of and claims priority to PCT International Application No. PCT/CA2004/000074, which was filed 21 Jan. 2004, and was published in English, and the teachings of which are incorporated herein by reference.

FIELD OF THE INVENTION

The present invention relates to electrodeposited metal sheets on permanent cathodes used in electro-winning and electrorefining techniques. More specifically, the present invention is concerned with a method and apparatus for stripping electrodeposited metal sheets from permanent cathodes.

BACKGROUND OF THE INVENTION

As is well known in the art, electro-winning refers to the technique of extracting a metal from its soluble salt by an electrolytic cell. It is used in recovery of zinc, cobalt, chromium, and manganese, and has recently been applied to copper when in the form of a silicate ore. For any specific metal, the salt in solution is subjected to electrolysis and is electro-deposited on a cathode starter plate. In particular, electro-winning techniques used to produce pure metallic copper from leach/solvent electrolytes consist of applying an electrical potential between inert lead alloy anodes and stainless steel or copper cathodes immersed in a $CuSO_4$—$H_2SO_4$—$H_2O$ electrolyte. Copper metal is deposited at the cathode and oxygen gas released at the anode. Purity of the refined copper can be maximized by, amongst other factors, providing for straight cathodes fabricated from stainless steel arranged vertically in the electrolytic bath and positioned at uniform distances.

Similarly, electro-refining refers to a technique for purifying metals by electrolysis using an impure metal as anode from which the pure metal is dissolved and subsequently deposited at the cathode. In particular, when electro-refining copper, copper is dissolved from impure copper anodes into a $CuSO_4$—$H_2SO_4$—$H_2O$ electrolyte. Pure copper without the anode impurities is plated onto the cathodes. Copper refined in this manner is of very high purity, typically with less than 20 ppm impurities plus oxygen which is controlled at about 0.025%.

When another metal, such as stainless steel, is used to fabricate the starter plate the refined metal deposited on the starter plate must be subsequently removed. In order to strip a starter plate covered with refined metal the prior art reveals systems where the plate is moved between a number of stations for washing, stripping, refinishing, etc. One problem with moving the plate is the weight of the deposited metal, which can be in excess of 300 kg., thereby requiring a robust and rugged structure for moving the plates.

Prior art systems include those using a linear conveyer, wherein the cathodes are conveyed, supported on a bottom edge, by a narrow pan-type conveyor, through multiple stripping stations. Other prior art systems, such as the one taught in U.S. Pat. No. 5,149,410 include those based on a rotary, top driven carousel with cathode plates conveyed through multiple stripping stations by the carousel. The cathode plates are suspended by hanger bars from supports mounted to the carousel base. One drawback of these systems is that, once separated from the starter plates, the metal deposit plates drop at least their full length to be removed by a conveyor. Additionally, the high mass with great inertia of the structure requires a heavy duty drive unit with its associated high capital cost.

There thus remains a need for an improved method and apparatus to stripping electro-deposited sheets from permanent cathodes.

OBJECTS OF THE INVENTION

An object of the present invention is therefore to provide an improved method and apparatus to stripping permanent cathodes.

SUMMARY OF THE INVENTION

More specifically, in accordance with the present invention, there is provided an apparatus for stripping electro-deposited metal sheets from a cathode blank, the blank having opposite faces, and upstream and downstream ends, at least one metal sheet being provided on at least one blank face and having upstream and downstream edges, the apparatus comprising:

a stripping assembly for stripping the metal sheet from the cathode blank;

a discharge assembly positioned downstream of the stripping assembly, the discharge assembly including opposite guide rollers adapted to engage the metal sheet exiting the stripping assembly; and a metal sheet out-feed assembly positioned downstream of the discharge assembly for receiving the metal sheet;

wherein, when the metal sheet has been stripped from the cathode blank, the guide rollers controllably feed the metal sheet towards the out-feed assembly while providing for the stripped metal sheet to rotate within its height.

In accordance with another aspect of the present invention there is provided a discharge assembly for an apparatus for stripping electro-deposited metal sheets from a cathode blank, the apparatus including a metal sheet stripping assembly adapted to be positioned upstream of the discharge assembly and a metal sheet out-feed assembly adapted to be positioned downstream of the stripping assembly, the discharge assembly comprising:

opposite guide rollers adapted to engage the metal sheet exiting the stripping assembly, and that once the metal sheet has been stripped from the cathode blank, the guide rollers controllably feed the metal sheet towards the out-feed assembly while providing for the stripped metal sheet to rotate within its height.

In accordance with a further aspect of the present invention there is provided a single-station apparatus for stripping electro-deposited metal sheets from a cathode blank, the blank having opposite faces, upstream and downstream ends, at least one metal sheet being provided on at least one blank face and having upstream and downstream edges, the apparatus comprising:

an in-feed assembly;

a stripping assembly positioned downstream of the in-feed assembly for stripping the metal sheet from the cathode blank and including:

- a hammering assembly for loosening the upstream edges of the metal sheets; and
- a separating assembly for separating unstripped portions of the metal sheet from the cathode blank;

a discharge assembly positioned downstream from the stripping assembly, the discharge assembly including opposite guide rollers adapted to engage the metal sheet exiting the stripping assembly; and a metal sheet out-feed assembly positioned downstream from the discharge assembly for receiving the metal sheet; wherein, the in-feeding, stripping, hammering, separating, discharge and out-feed of the metal sheet is effected in a single continuous station, and said guide rollers controllably feed the metal sheet towards said out-feed assembly while providing for the metal sheet to rotate within its height.

In accordance with yet another aspect of the present invention there is provided a method for stripping electrodeposited metal sheets from a cathode blank, the blank having opposite faces, upstream and downstream ends, at least one sheet being provided on at least one blank face and having upstream and downstream edges, the method comprising:

stripping the metal sheet off the cathode blank; and controllably feeding the stripped metal sheet 4e towards an out-feed assembly while providing for the stripped metal sheet to rotate within its height.

An advantage of the present invention is that the metal sheet is controllably discharged from the stripping assembly after it has been stripped from the cathode blank.

Other objects, advantages and features of the present invention will become more apparent upon reading of the following non-restrictive description of embodiments thereof, given by way of example only with reference to the accompanying drawings.

BRIEF DESCRIPTION OF THE DRAWINGS

In the appended drawings where like elements are referenced by like reference numerals and in which:

FIGS. 1, 2, 3, 4, 4A and 4B are front elevation views of the apparatus for stripping electrodeposited metal sheets from a permanent cathode showing the sequential stripping of the metal sheet from the cathode and its discharge from the apparatus in accordance with an embodiment of the present invention;

BRIEF DESCRIPTION OF THE EMBODIMENTS

Figure 1:
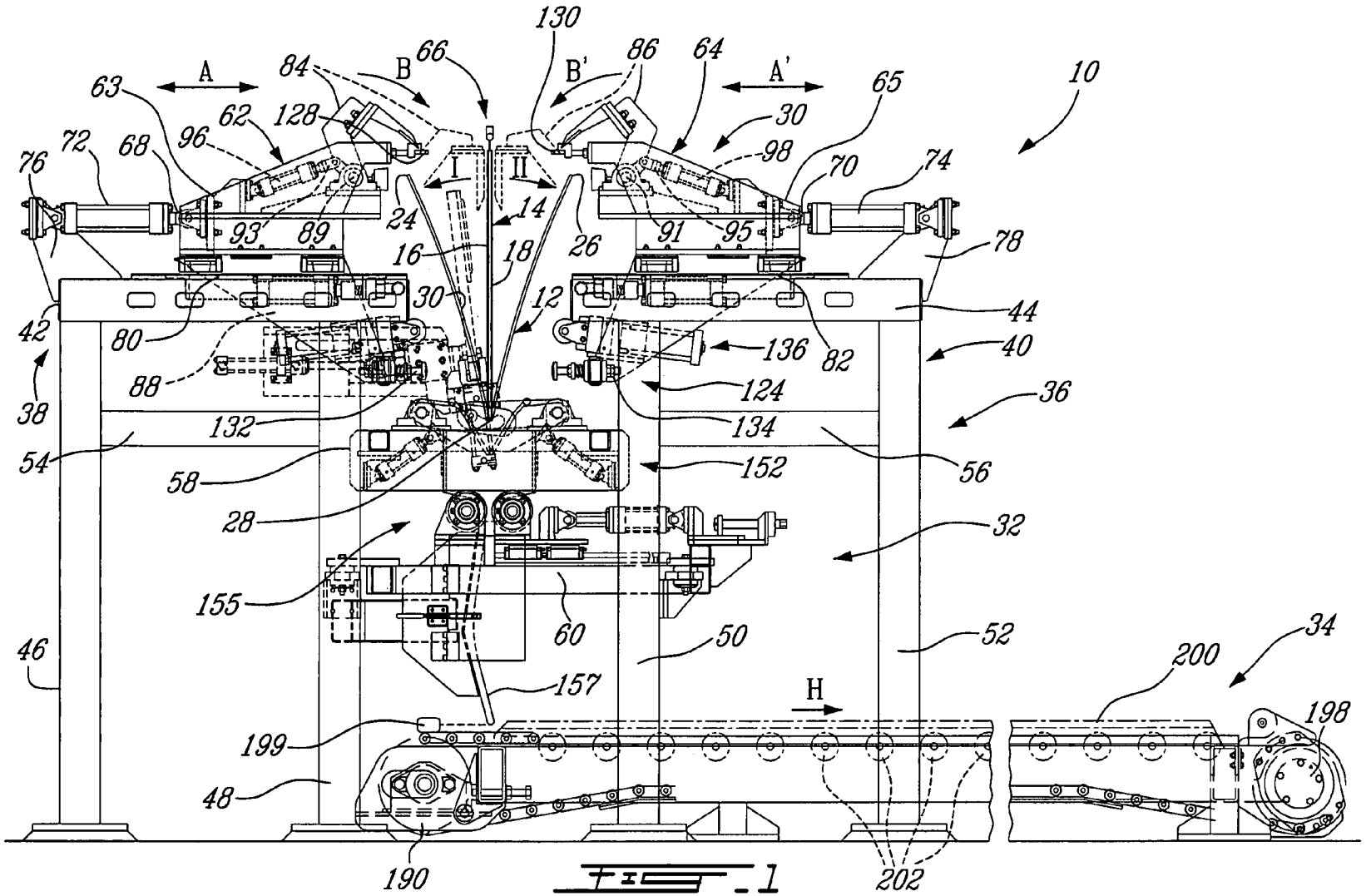

With reference to the appended drawings, embodiments of the present invention will be herein described so as to exemplify the invention only and not limit its scope.

FIGS. 1 to 4 show the apparatus 10 for stripping electrodeposited metal sheets 12 from a cathode blank 14.

With particular reference to FIGS. 1, 6, 8 and 9 the cathode blank 14 has opposite faces 16 and 18 as well as upstream and downstream ends 20 and 22 respectively.

With particular reference to FIGS. 1, 5, 6, 7, 8 and 9, the metal sheets 12 are provided on one of or on both opposite cathode blank faces 16 and 18, as shown here, and define respective upstream edges 24 and 26 and respective downstream edges 28. In this example, edges 28 are contiguous and form a single common edge. As such, the metal sheet 12 includes two metal sheets or metal sheet portions 12*a* and 12*b* (see FIGS. 6, 8 and 9) enveloping the cathode blank and meeting at a common edge 28 to form a V-like or U-like structure.

Returning to FIG. 1 to 4, apparatus 10 comprises a stripping assembly 30, a discharge assembly 32, positioned downstream of the discharge assembly 30 and a metal out-feed assembly 34 positioned downstream of the discharge assembly 32.

Figure 3:
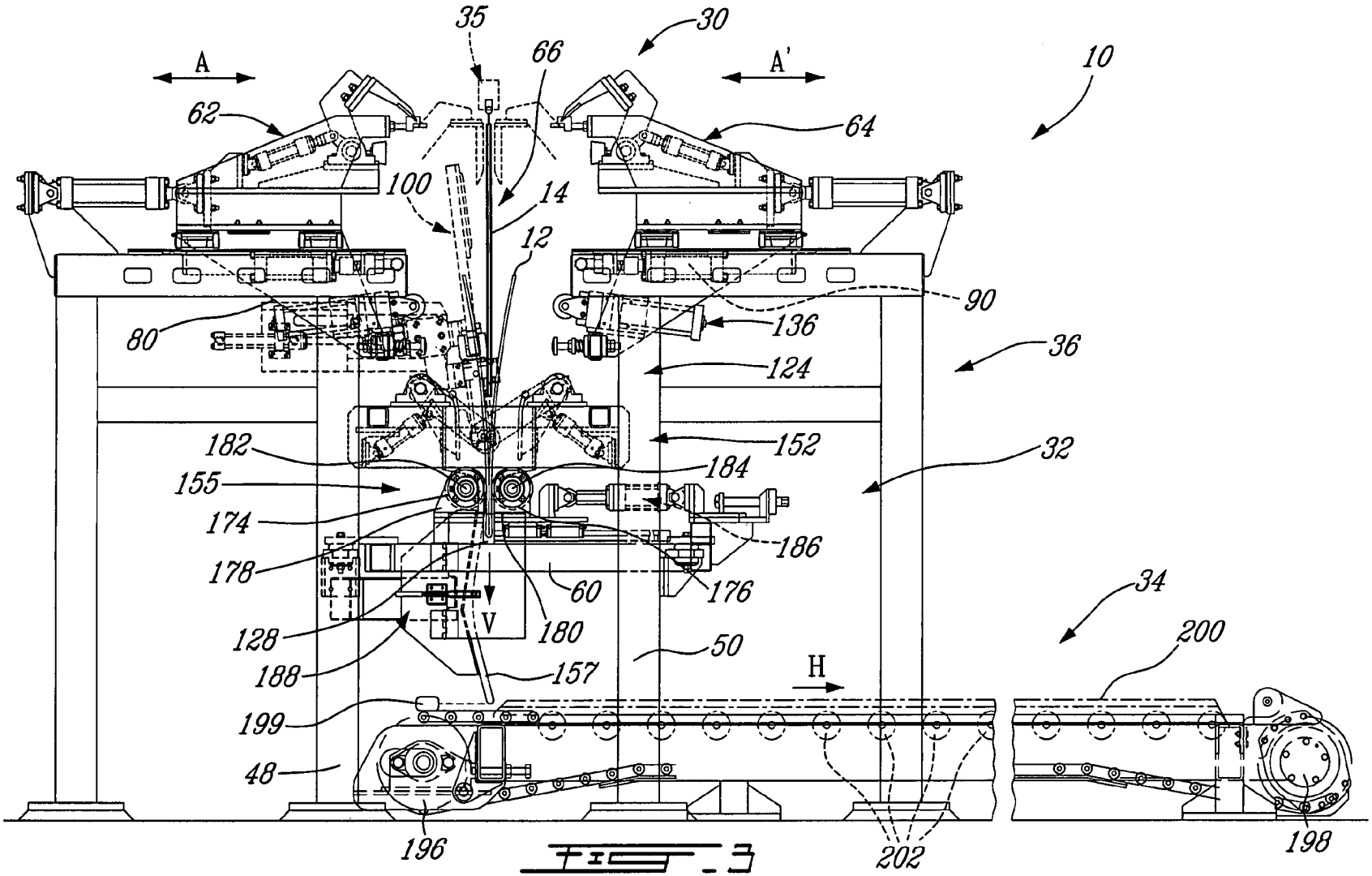
Figure 5:
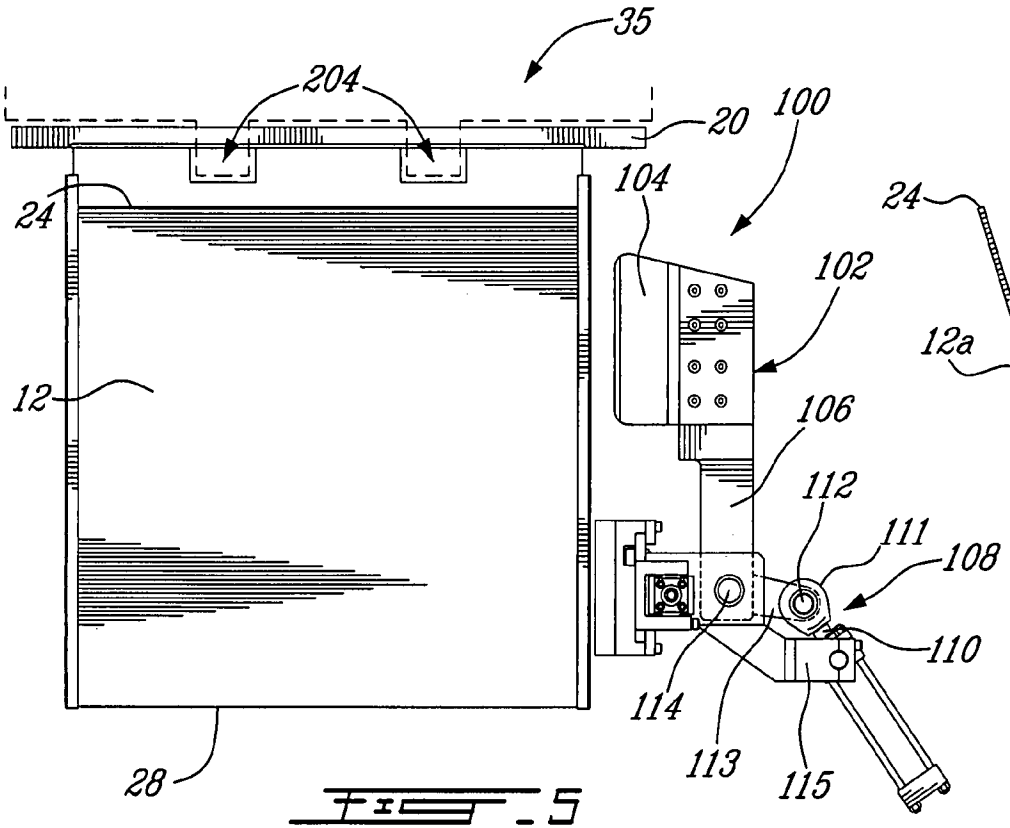
FIG. 5 is a side sectional view taken along line 5—5 of FIG. 1, showing the separating assembly of the apparatus as well as the cathode and metal sheet in accordance with an embodiment of the present invention.
Figure 7:
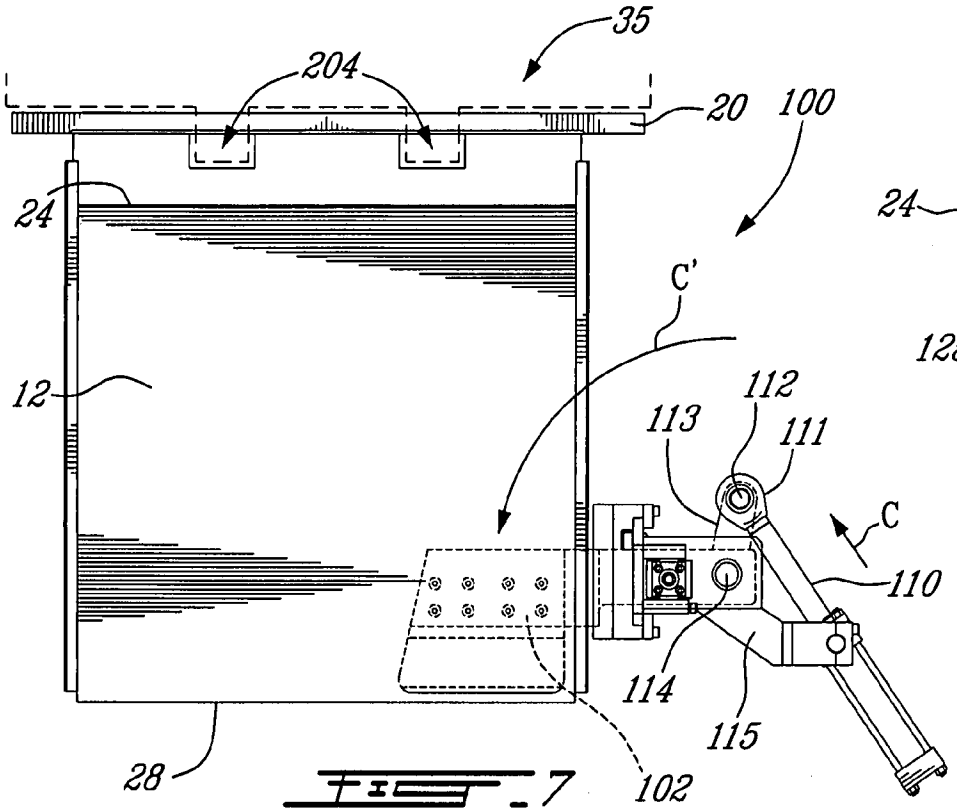
FIG. 7 is a side view of the separating assembly similar to FIG. 5 with the knife member shown in an operational position.

Apparatus 10 also includes a cathode in-feed assembly 35 upstream the stripping assembly 30 (see FIGS. 3, 5 and 7).

Apparatus 10 further includes a support frame assembly 36, which is a structural welded assembly of rectangular hollow structural sections, for supporting the above-mentioned assemblies as will be explained herein. The support frame assembly 36 includes two table members 38 and 40 having respective top members 42 and 44. The top members 42 and 44 are upstanding on respective pairs of leg members 46, 48 and 50, 52. Leg members 46 and 48 are stabilised by interconnecting member 54; leg members 50 and 52 are stabilised by interconnecting members 56. The support frame assembly 36 also includes upper and lower median members 58 and 60, respectively, mounted between leg members 48 and 50.

The stripping assembly 30 includes a pair of opposed and spaced-apart stripping members, 62 and 64, which define a cathode blank receiving area 66 therebetween (also see FIG. 3).

Figure 4:
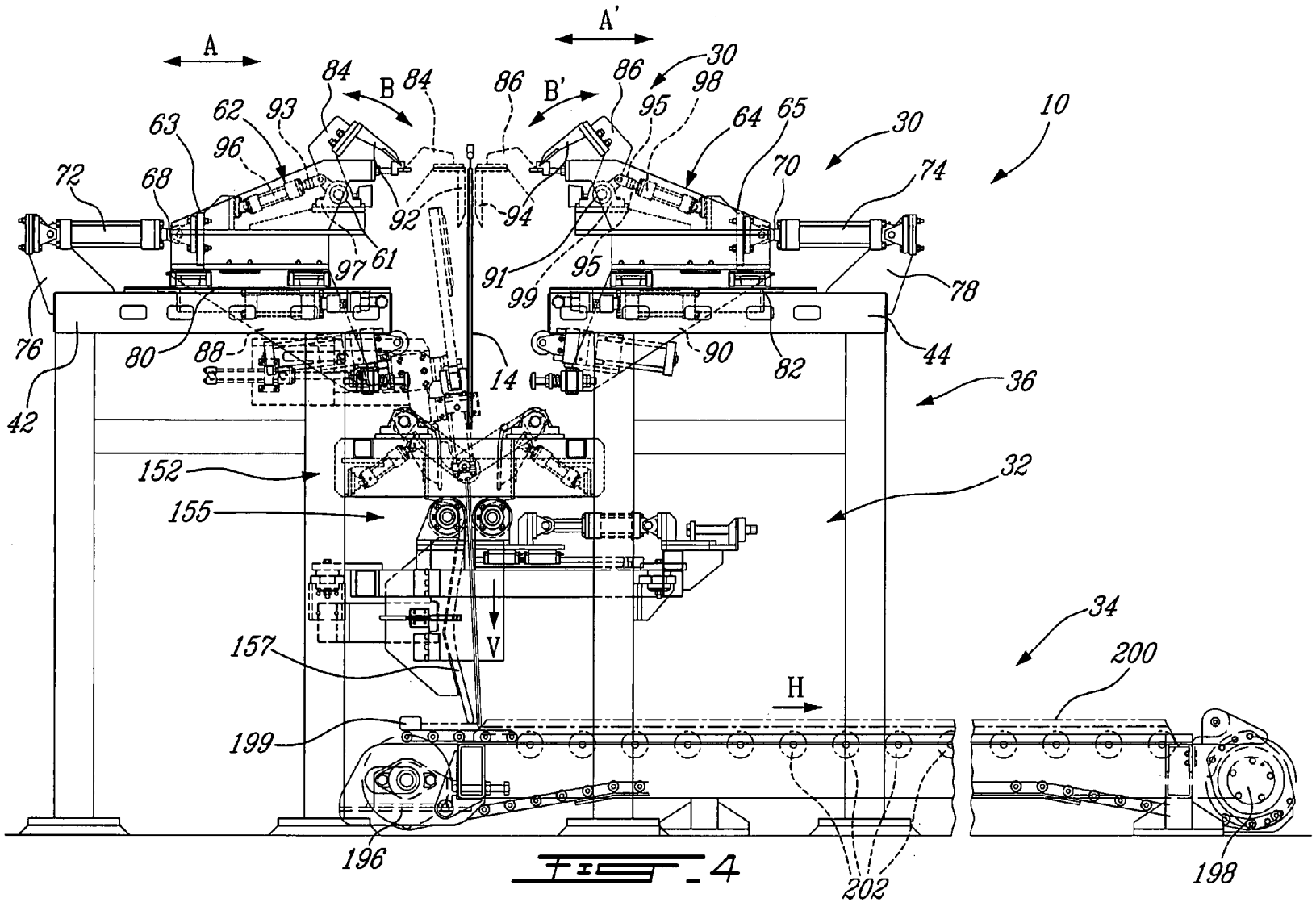

With reference to FIGS. 1 and 4, each stripping member 62 and 64 includes respective reciprocally mobile carriages 63 and 65.

Reciprocally mobile carriages 63 and 65 have respective backs end 68 and 70 mounted to respective actuators 72 and 74 for reciprocal movement towards and away the cathode blank receiving area 66 as shown by arrows A and A'. Actuators 72 and 74 are mounted to the top support members 42 and 44 via support-structures 76 and 78 respectively. The mobile carriages 63 and 65 include respective sliding surfaces, 80 and 82. Surfaces 80 and 82 are respectively and slidably mounted to top support members 42 and 44 via guide members (not shown).

The stripping members include extension members 88 and 90 downwardly extending from carriages 63 and 65 respectively.

The stripping members 62 and 64 include respective mobile finger members 84 and 86.

Each finger member 84 and 86 includes a respective blade member 92 and 94 (see FIG. 4) and is pivotally mounted to a carriage 63 and 65 via pivots 89 and 91 respectively. The fingers 84 and 86 are mounted to finger-actuating assemblies 96 and 98 respectively. Actuating assemblies 96 and 98 include respective actuators 93 and 95 (see FIG. 4). In this way, actuators 93 and 95 can actuate fingers 84 and 86 causing them to reciprocally pivot about pivots 89 and 91 towards and away the receiving area 66, as shown by arrows B and B'.

The stripping members 62 and 64 include respective top clamp members 128 and 130 (see FIG. 1) mounted to carriages 63 and 64 as well as and respective bottom clamp members 132 and 134 (see FIG. 1) mounted to extensions 88 and 90. Top clamp members 128 and 130 are polyurethane covered clamps. Bottom clamps 132 and 134 are spring-loaded metal clamps. Top clamps 128 and 130 are configured to clamp the top edges 24 and 28 of the metal sheet 12 whereas bottom clamps 132 and 134 are configured to clamp the bottom edge 28 of the metal sheet 12 as will be explained herein.

With reference to FIG. 3, the stripping assembly 30 includes a separating assembly 100 downstream of the spaced-apart stripping members 62 and 64.

With particular reference to FIG. 5, 6, 7 and 8 the separating assembly 100 includes a mobile knife member 102. Knife member 102 includes a blade 104 and a handle portion 106. The handle portion 106 is mounted to a knife-actuating assembly 108. More specifically, the knife-actuating assembly 108 includes an actuator 110 having a top portion 111 pivotally mounted via pivot 112 to an extension 113 extending from the handle portion 106. The handle portion 106 is pivotally mounted at pivot 114 to an extension 115 extending from the actuating assembly 108. During actuation, the actuator 110 moves upwardly as shown by arrow C in FIG. 7 so as to move the knife member 102 in a vertical sweeping motion as shown by arrow C'. The knife member 102 is also mounted to a side-movement actuating assembly 116. Actuating assembly 116 includes a horizontal-actuator 118 mounted to the knife handle 106 via a connector 120 to horizontally move the knife member 102 side to side as shown by arrow D. The connector 120 includes an adjustable double nut lock 122 to adjust the angle or inclination of the knife member 102.

Figure 2:
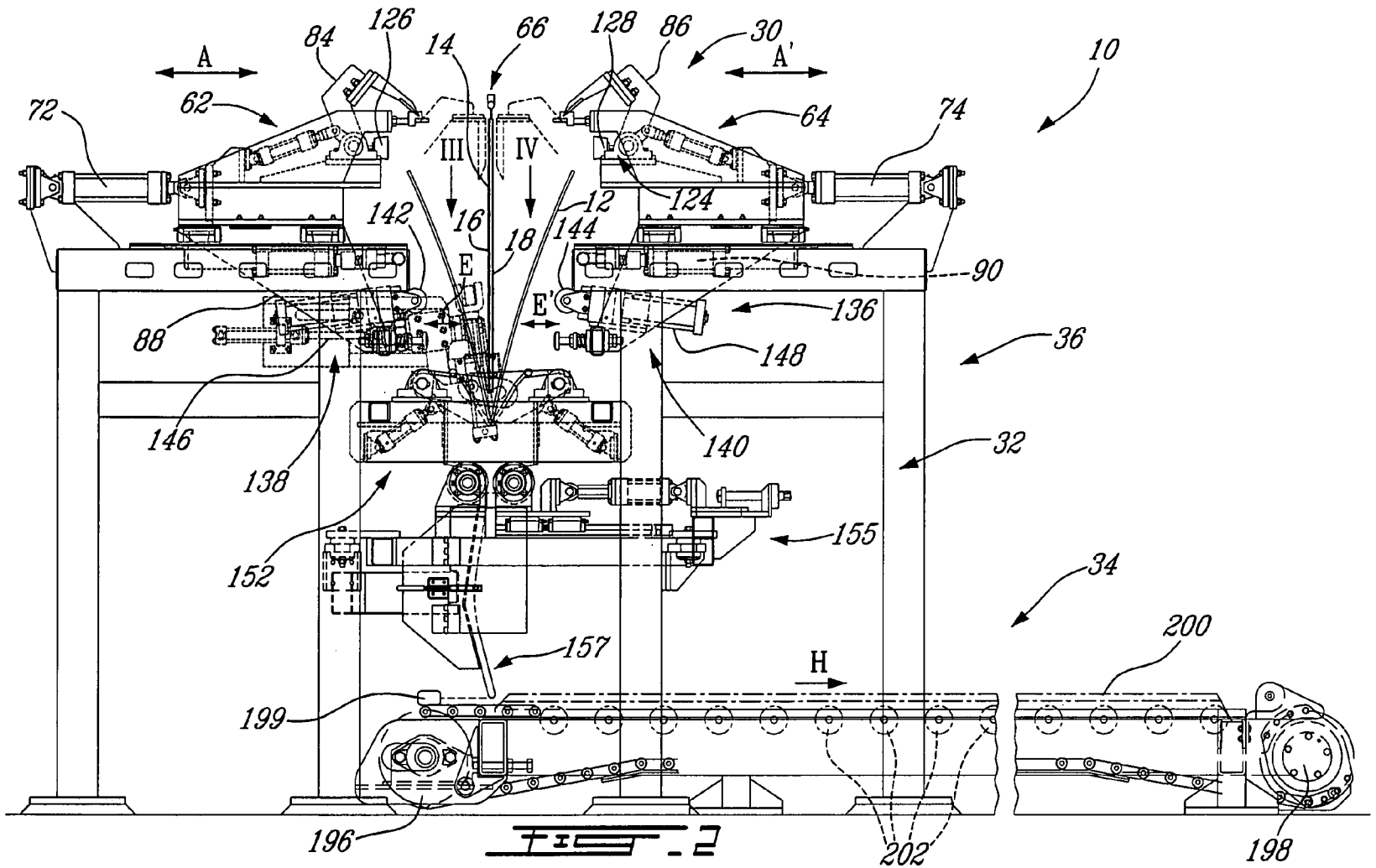

Turning to FIG. 2, the stripping assembly 30 also includes a hammering assembly 124.

With reference to FIG. 2, the hammering assembly 124 includes opposite spaced-apart hammer members 126 and 128 mounted to carriages 62 and 64 respectively. The hammer members 126, 128 are air hammers configured to release the upper edges of 24 and 28 as will be explained below.

Referring to both FIGS. 1 and 2, the stripping assembly 30 further includes a folding assembly 136 downstream of the stripping members 62 and 64.

Turning to FIG. 2, the assembly 136 includes a pair of spaced-apart folding members 138 and 140 respectively mounted to extensions 88 and 90. Folding members 138 and 140 include idle-rollers 142 and 144 mounted to respective hydraulic actuators 146 and 148. In this way idle rollers 142 and 144 are reciprocally moveable as shown by arrows E and E'.

Referring again to FIGS. 1–4, the discharge assembly 32 includes a gate assembly 152, a roller assembly 155 downstream the gate assembly 152 and a guide member 157 downstream the roller assembly.

Figure 9:
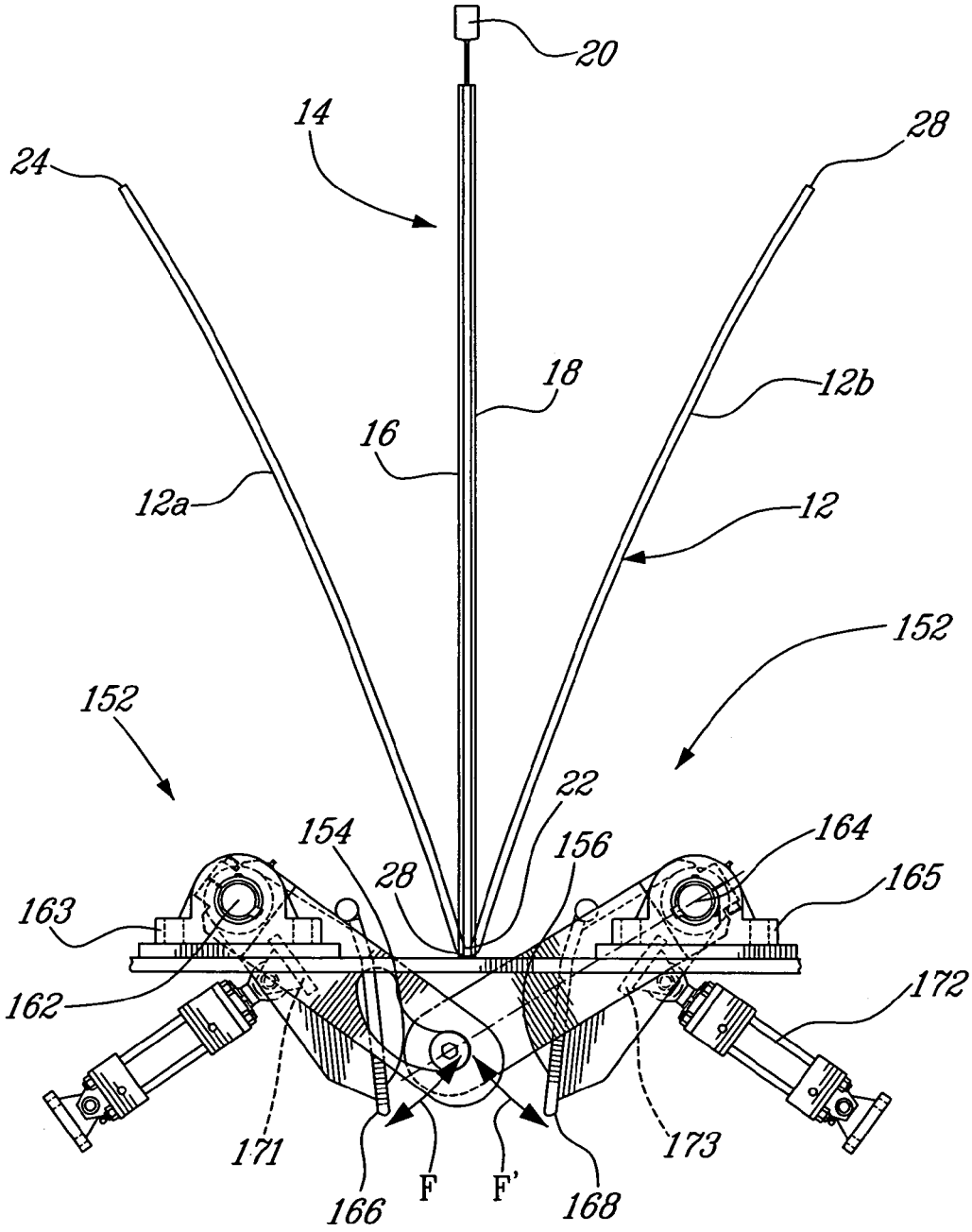
FIG. 9 is a front elevation view of the gate assembly of the present invention in accordance with an embodiment thereof.
Figure 10:
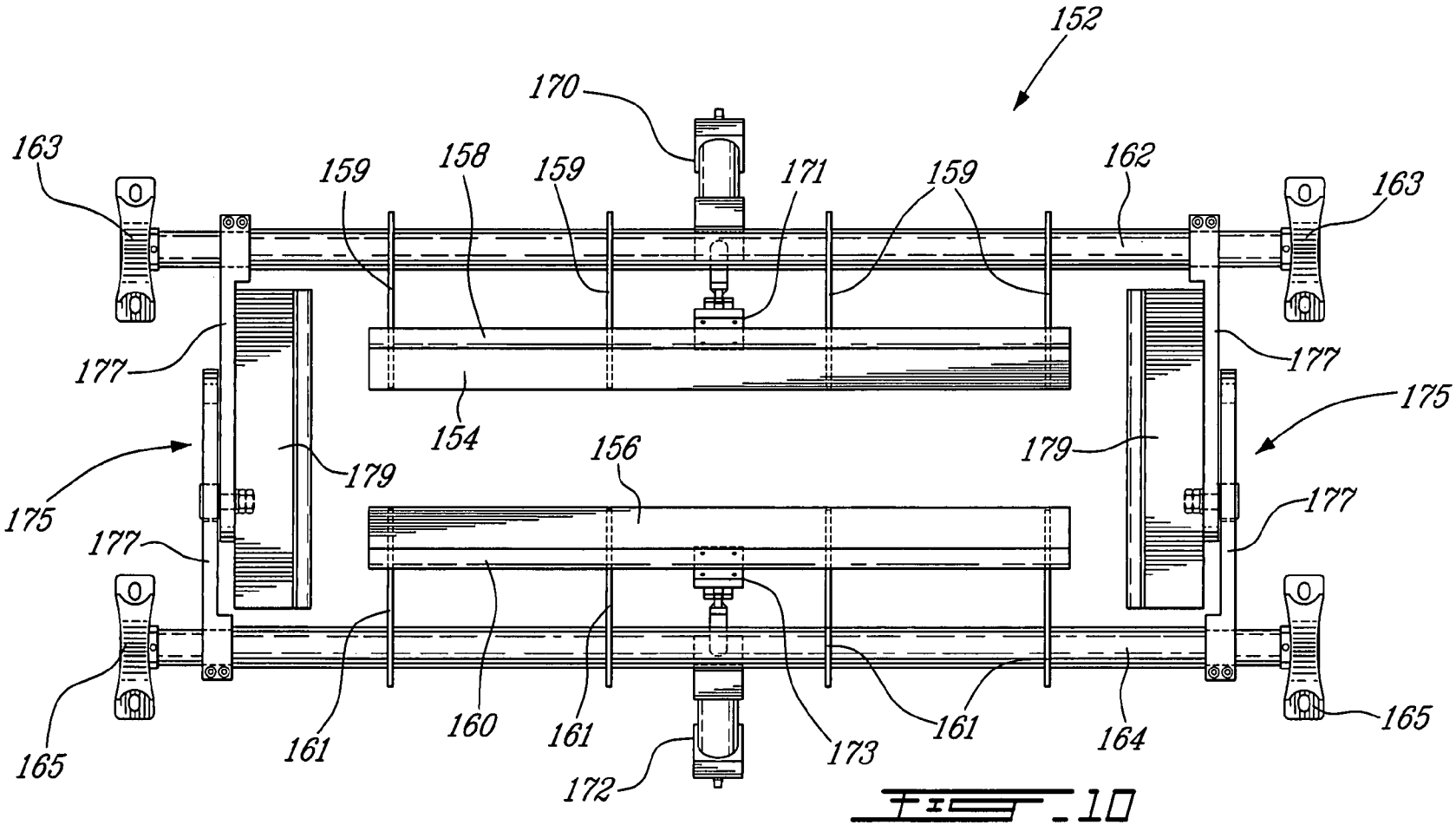
FIG. 10 is a top plan view of the gate assembly of FIG. 9.

Turning now to FIGS. 9 and 10, the gate assembly 152 includes a pair of opposite gate members 154 and 156. With particular reference to FIG. 10, gate members 154 and 156 have respective ends 158 and 160 pivotally mounted via supports 159 and 161 to respective shafts 162 and 164. Shafts 162 and 164 are mounted to respective pairs of shaft-supports 163 and 165. Shaft supports 163 and 165 are mounted upper median sections 58 (only one upper median section is illustrated here) of the frame support assembly 36.

The gate members 154 and 156 downwardly extend from their respective ends 158 and 160 to meet at their other opposite respective ends 166 and 168 when closed as will be explained. Actuators 170 and 172 act on gates 154 and 156 via linkages 171 and 173 so as to upwardly or downwardly pivot the gate members 154 and 156 along shafts 162 and 164 and as such, reciprocally closing and opening the gate members 154 and 156 as show by arrows F and F'.

Furthermore, the gate assembly 152 includes two passive side-guide assemblies 175 to guide the falling stripped metal sheet 12. Each side guide assembly includes linked members 177 and a deflector 179. It should be noted that when the gate members 156 and 158 are closed they form a generally V-like or U-like structure to emulate the lower portion of the metal sheet 12 near the common edge 28. This V-like or U-like structure acts as a support for the common edge 28.

Figure 11:
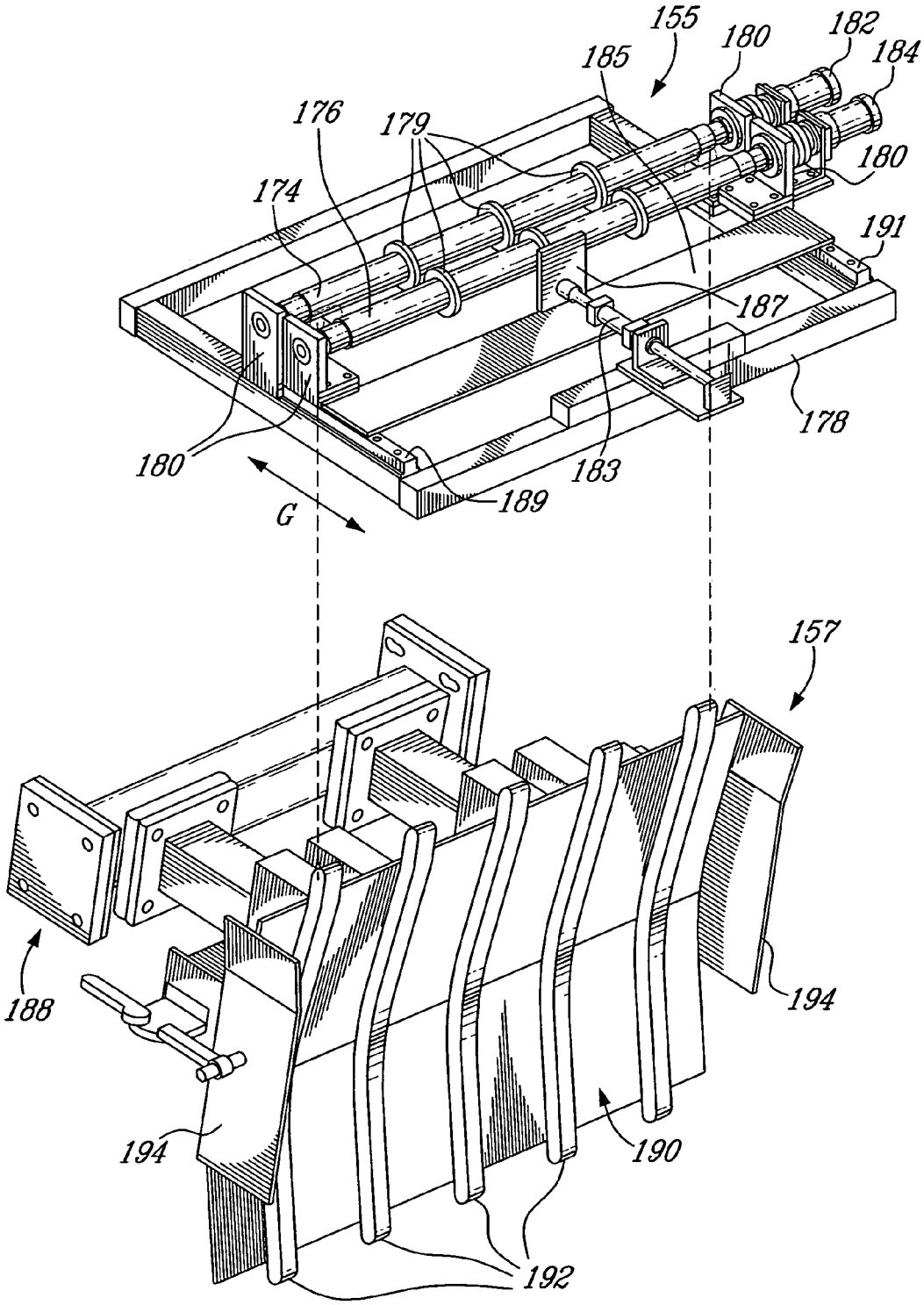
FIG. 11 is a perspective view of the discharge assembly of the present invention in accordance with an embodiment thereof.

With reference to FIGS. 3 and 11, the roller assembly 155 includes a pair of opposite and spaced apart pinch rollers 174 and 176 mounted to the lower median member 60 via a base member 178.

Rollers 174 and 176 are longitudinal rod members having spaced apart ribs 179 along their lengths and being journalled to brackets 180 at their longitudinal ends; brackets 180 being mounted to the base member 178. Rollers 174 and 176 are couple to rotary actuators 182 and 184, which are powered by a roller-actuating assembly (not shown) so as to rotate the rollers 174 and 176 about their respective longitudinal axis.

In a non-limiting embodiment, each pinch or drive roller 174 and 176 is powered by a low speed-high torque hydraulic motor directly coupled thereto. A flow divider (not shown) keeps the rotary speed of the rolls similar.

The roller assembly 155 includes a lateral actuator 183 powered by an actuating assembly 186 (see FIG. 3) mounted to the lower median member 60 and to leg member 50. Actuator 183 mounted to the base members 178 and to roller 176 for reciprocal lateral movement thereof as shown by arrow G. Specifically, actuator 183 is mounted to a panel 185 via a connector 187; the panel 185 in turn is mounted to the brackets 180 to which roller 176 is journalled. The foregoing brackets 180 and panel 187 are slidably mounted on opposite lateral guides 189 and 191 of the base member 178. In this way, the panel 187, brackets 180 and roller 178 are laterally moveable along guides 189 and 191 as shown by arrow G by way of the actuator 183 acting thereon.

It should be noted that the aforementioned divider valve can keep the speed of rollers 174 and 176 similar even during lateral retraction of roller 176.

The discharge assembly 155 includes a sensor 199 for detecting the position of the discharged metal sheet 12 as will be explained herein. In an embodiment, the sensor is laser type photo sensor that detects the common or lower edge 28 of the metal sheet 12 as it nears the out-feed assembly 34.

The guide member 157 is downstream the roller assembly 155 and is a longitudinal slightly curved generally vertical member. Guide member is supported by a guide-support structure 188 mounted to leg member 48. In a non-limiting example, the guide member 157 includes a guide face 190 having wear bars 192 and side deflectors 194 which guide the stripped metal sheets 12 from side to side when it is translated from a vertical to a horizontal position on the out-feed assembly 34 as will be further explained herein.

With reference to FIGS. 1, 2, 3 and 4, the out-feed assembly 34 is a conveyor assembly including opposite conveyor rollers 196 and 198 with a conveying carpet 200 mounted thereto. Conveyor rollers 196 and 198 are motorized to move the carpet in the direction shown by arrow H and is guided via idle guide rollers 202.

Turning to FIGS. 5 and 7, the cathode blank in-feed assembly 35 includes a cathode carrying member or hanger 204 engaging the upstream end 20 of the cathode blank 14. This in-feed assembly 35 may be a carrousel or a carriage that moves the cathode horizontally on linear bearing rails. A variety of suitable in-feed assemblies may be used in the context of the present invention.

Figure 12:
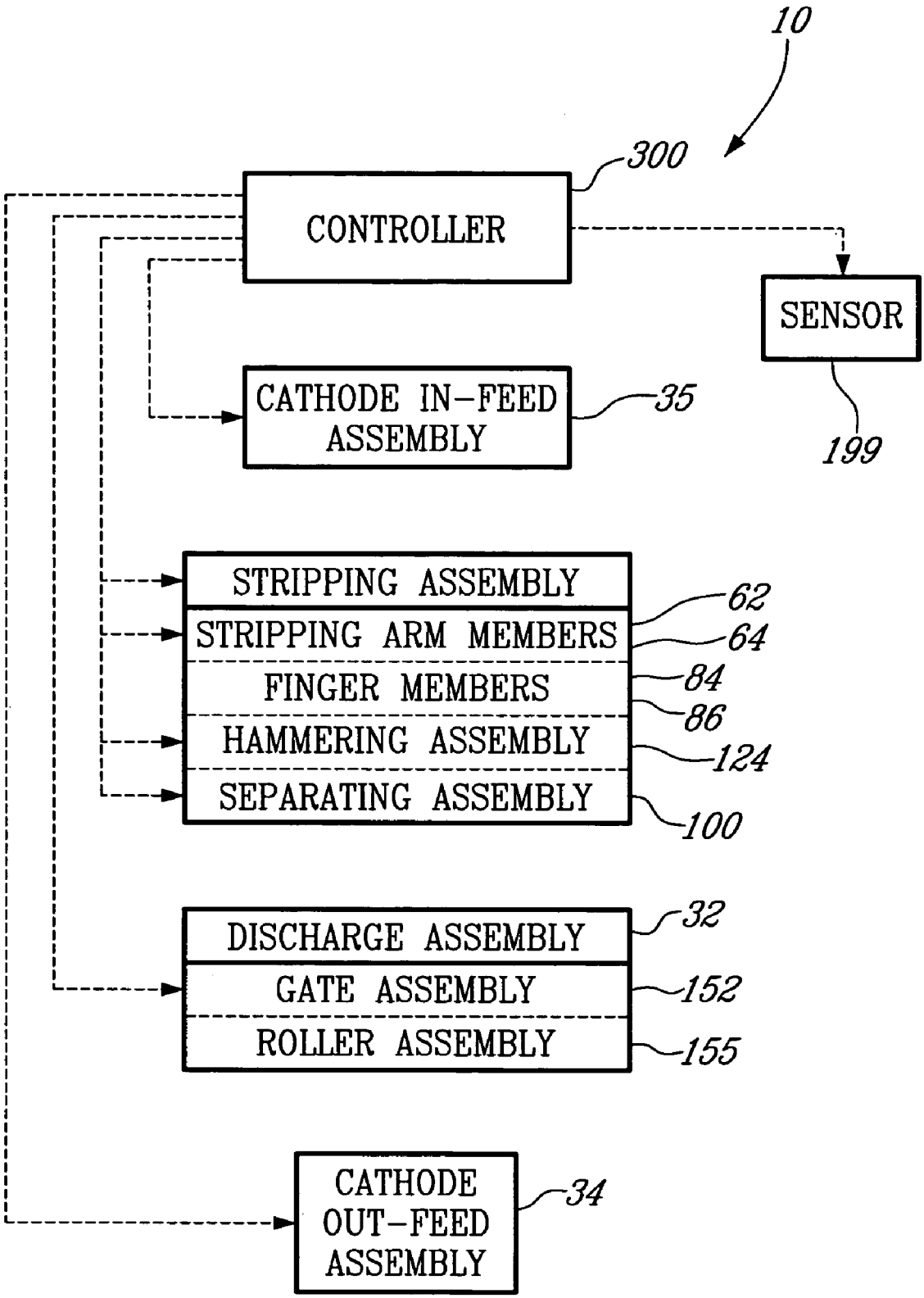
FIG. 12 is a schematic view of the present apparatus including a controller in accordance with an embodiment of the present invention.

With reference to FIG. 12, apparatus 10 may be linked to a controller 300, such as a data processor or computer or it may be independently linked to the cathode in feed assembly 35, the stripping assembly 30 including the stripping members 62, 64 and the mobile fingers 84, 86, the hammering assembly 124, the discharge assembly 32 including the gate assembly 152 and the roller assembly 155 as well as the sensor 199, the cathode out-feed assembly 34 so as to receive data therefrom, analyse this data and send a signal so as to control the foregoing. As those having ordinary skill in the art can easily understand, the controller 300 may be directly linked to the various actuating assemblies of the foregoing via direct wiring or by remote wireless linkage.

In operation, the cathode in-feed assembly 35 brings the cathode blank 14 with the metal sheet 12 electro-deposited thereon to the cathode receiving area 66. Hence, the cathode 14 with metal sheet 12 hangs from hanger 204 in the receiving area 66.

The stripping members 62 and 64 are extended by their respective actuators 72 and 74 towards the cathode blank receiving area 64, respectively sliding along top support members 42 and 44. In this way, the top clamp members 128 and 130 clamp the upstream edges 24 and 26 of the metal sheet 12 while the bottom clamp members 132 and 134 clamp the metal sheet 12 at each cathode face 16 and 18 near the downstream common edge 28.

Air hammers 126 and 128 which at this point are near the upstream edges 24 and 26 act thereon so as to loosen and release edges 24 and 26 from the cathode blank 14.

Fingers 84 and 86 are then pivoted towards the receiving area 66, causing blades 92 and 94 to cut between the upstream metal sheet edges 24 and 26 and the cathode blank faces 16 and 18 respectively. When the blades 92 and 94 have been fully inserted between the metal sheet portions 12*a* and 12*b* and the cathode blank faces 16 and 18, the stripping members 62 and 64 are moved away from the cathode blank receiving area 66. Since fingers 84 and 86 grip upstream portions (near the upstream edges 24 and 26) of the metal sheet portions 12*a* and 12*b*, these portions are stripped off cathode faces 16 and 18 as shown by arrows I and II in FIG. 1. When stripping members 62 and 64 have been completely retracted in this way, the fingers 84 and 86 upwardly pivot away from the metal sheet 12.

Figure 6:
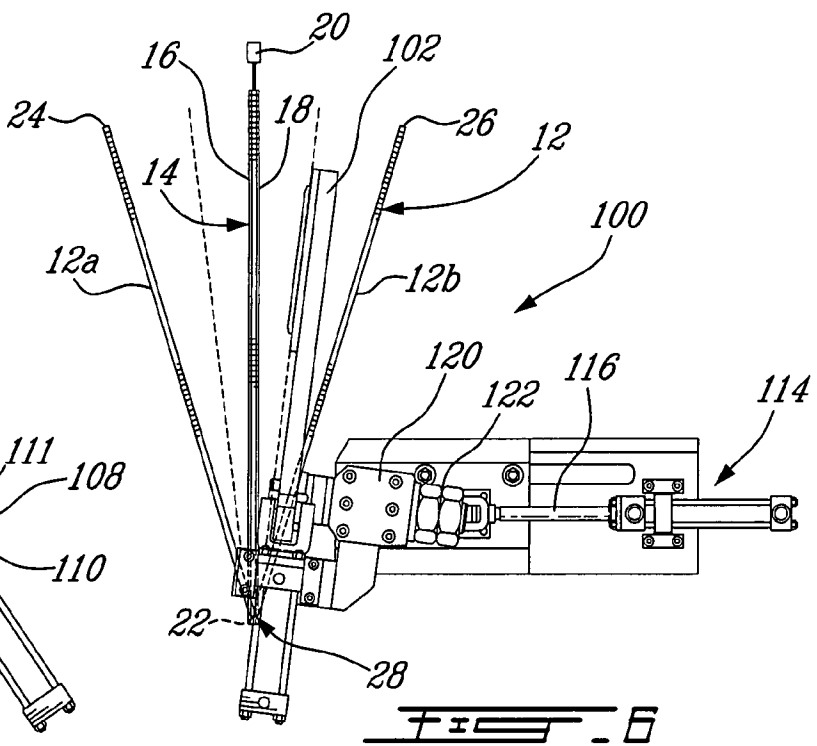
FIG. 6 is a front view of the separating assembly of FIG. 5 with the knife member of the present invention, in this case, being positioned in an opposite inclination than the inclined position shown in FIG. 1 with respect to the cathode.
Figure 8:
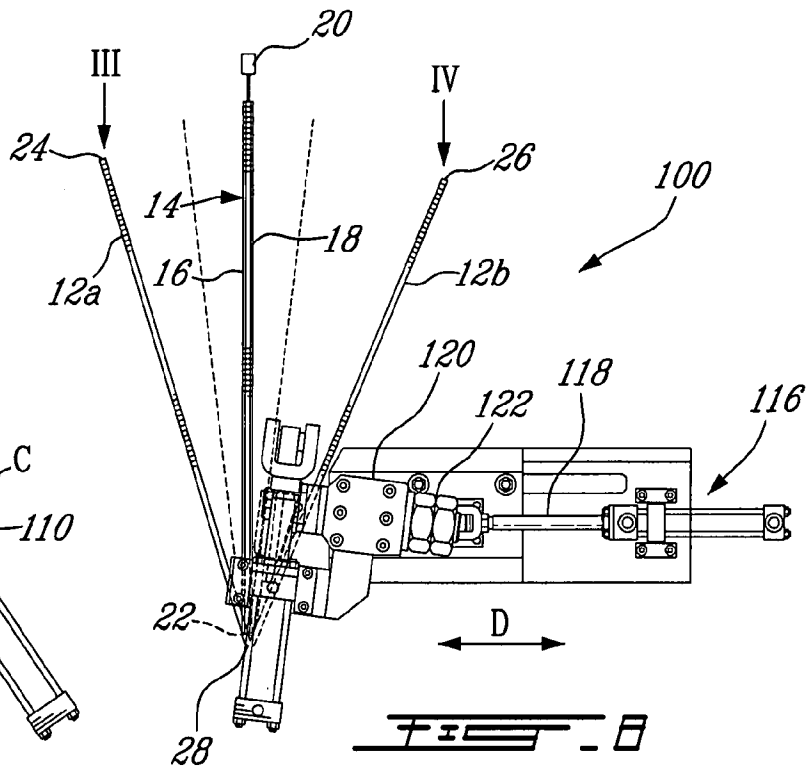
FIG. 8 is a front view of the separating assembly of FIG. 5 with the knife member shown in an operational position.

In many cases, the downstream portions of the metal sheet 12 near the common edge 28 on both sides of the cathode blanks 16 and 18 will remain stuck to the cathode blank 14. On these occasions, the knife member 102 is horizontally moved between a given cathode face 16 and 18 and a given stripped metal sheet portion 12*a* and 12*b*. It should be noted that the angle or inclination of the knife member 102 would be adjusted by way of its adjustable double nut lock 122. Hence, the knife member 102 is inclined similarly to the inclination of a stripped metal sheet 12*a* or 12*b* depending on which face 16 and 18 of the cathode blank 14 it will be used. In the example of FIGS. 6 and 8, knife member 102 is between cathode blank face 18 and the inclined stripped metal sheet portion 12*a*. As shown in FIGS. 7 and 8, knife member 102 sweeps between the metal sheet portion 12*b* and the cathode blank face 18 cutting the metal sheet portion 12*b* off the cathode blank face 18. This will be repeated between the cathode blank face 16 and the stripped metal sheet 12*a* if necessary.

When the metal sheet 12 is completely stripped from the cathode blank 14, gravity causes it to fall, as shown by arrows III and IV in FIGS. 2 and 8, and to hit with edge 28 the closed gate members 154 and 156 which act as a support.

As the metal sheet 12 is stripped off the cathode blank, the deployed metal sheet portions 12*a* and 12*b* engage idle rollers 142 and 144. The folding members 138 and 140 act on metal sheet portions 12*a* and 12*b* in order to fold them together as these slide portions 12*a* and 12 downwardly slide along rollers 142 and 144 until the common edge abuts the support formed by closed gate members 154 and 156.

Gate members 154 and 156 are slowly opened allowing the stripped metal sheet 12 to slide therethrough. The open gate members 154 and 156 provide an opening such that the metal sheet portions 12*a* and 12*b* are maintained in the folded position as they slide therethrough.

As the stripped metal sheet 12 falls through the open gate assembly 152, common edge 28 of the stripped metal sheet 12 will engage the space formed between pinch rollers 174 and 176.

It should be noted that the small space between rollers 174 and 176 is such that the metal sheet 12 cannot slip or slide therethrough.

The pinch rollers 174 and 176 are motorized and hence they controllably lower the metal sheet 12 through the open gate assembly 152, as shown by arrow V in FIGS. 3 and 4, and controllably feed the metal sheet 12 towards the out-feed assembly 34 via the guide member 157 as shown in FIG. 4.

Rollers 174 and 176 exert sufficient pressure on the metal sheet 12 to simultaneously join portions 12*a* and 12*b* thus flattening the V shaped metal sheet 12 as it is lowered.

In this way, the rollers 174 and 176 control the speed of the metal sheet's drop and the guide member 157 controls its positioning during its drop towards the out-feed assembly 34.

Figure 4A:
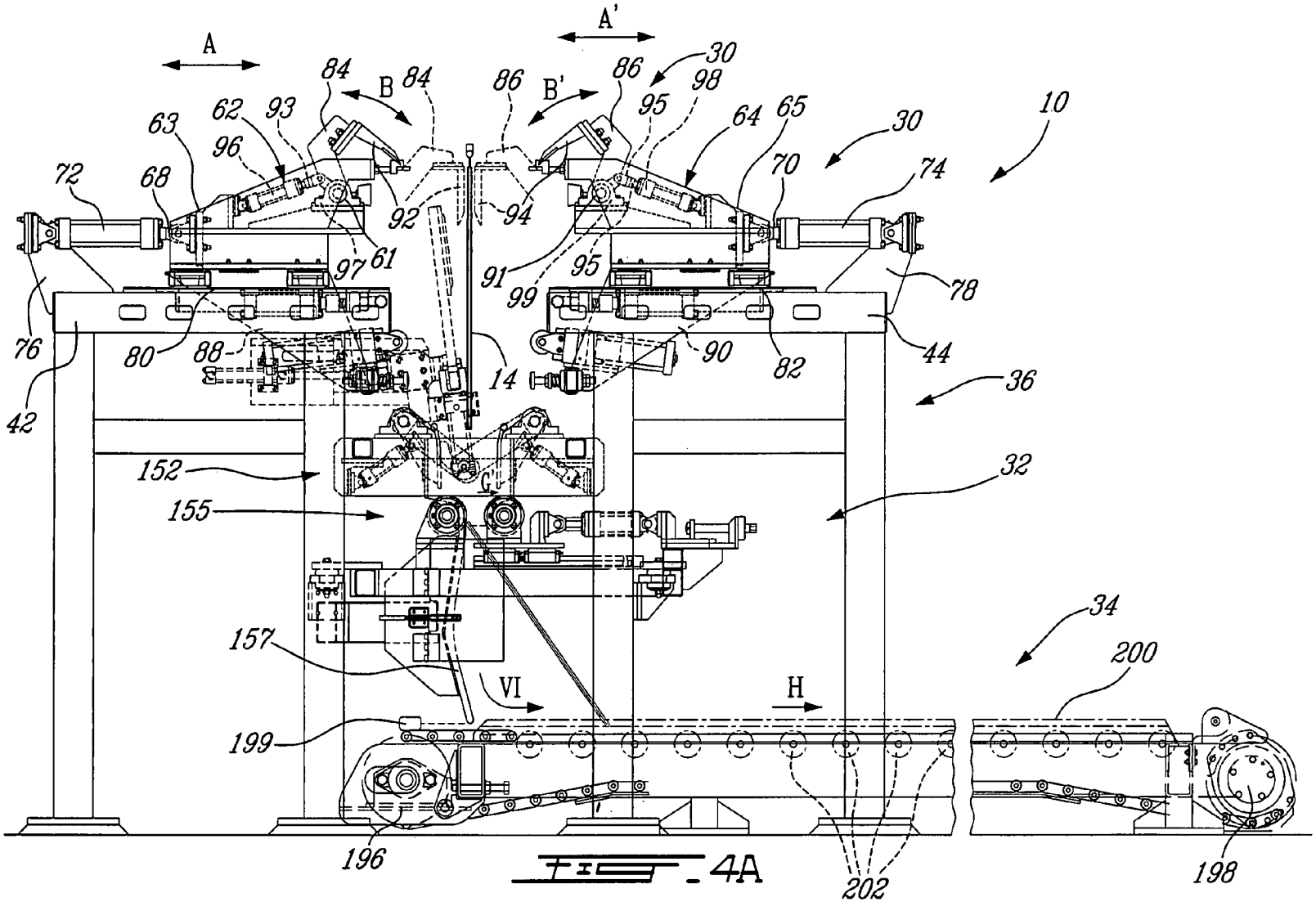
Figure 4:
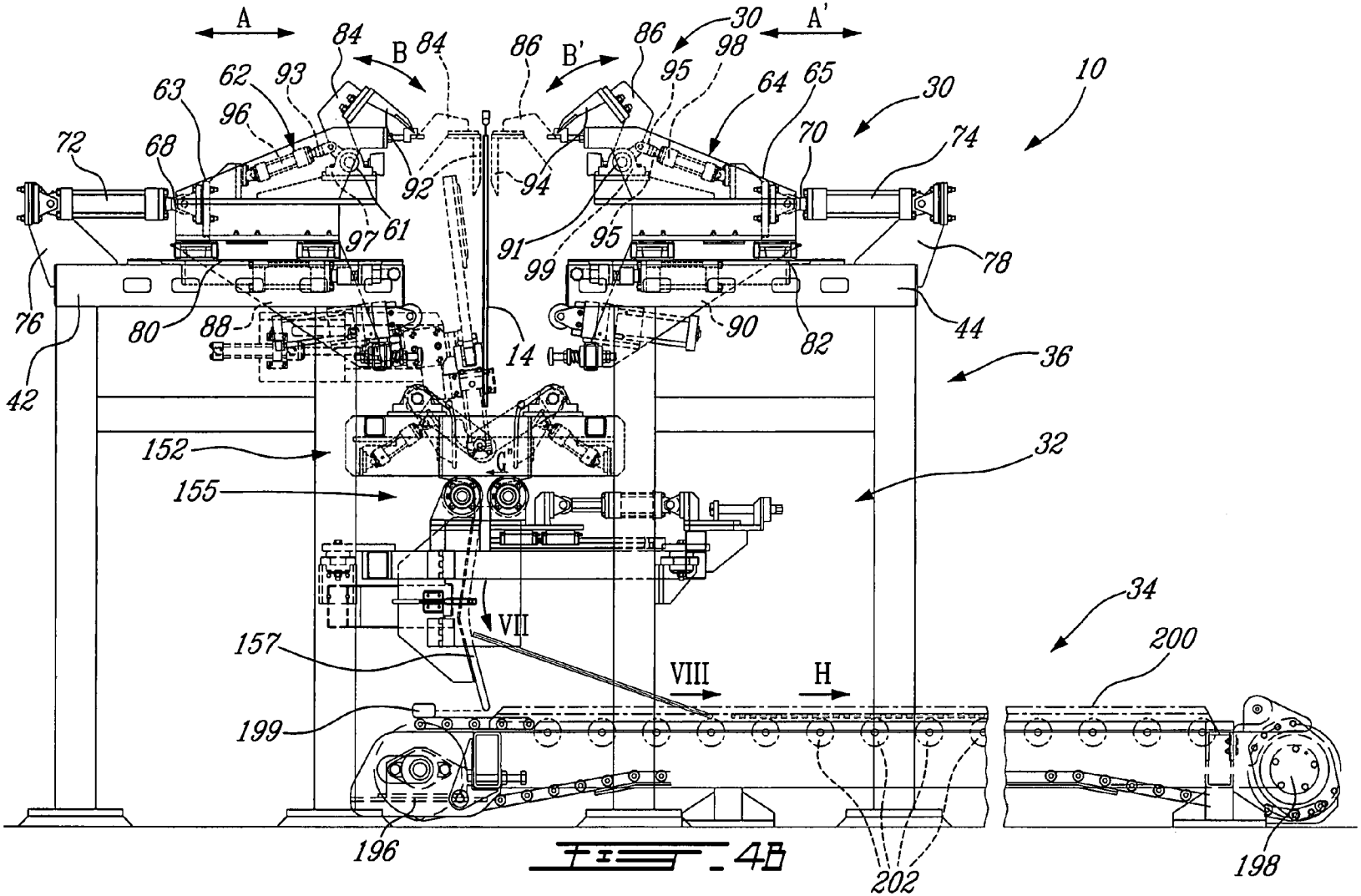

As the common edge 28 of the metal sheet 12 engages the conveying carpet 202, the sensor 199 detects the edge 28 nearing carpet 202 and signal actuating assembly 186 to progressively retract roller 176 away from roller 174, as shown by arrow G' in FIG. 4A, creating a larger space therebetween. This increasing space allows the flattened metal sheet 12 to incline, as shown by arrow VI, as the common edge is dragged away in the direction shown by arrow H.

As the common edge 28 continues to be dragged away by carpet 202 the joined top edges 24 and 26 disengage the pinch rollers 174 and 176 and to slide down guide 157, as shown by arrow VII until they engage the carpet 202. In this way, the flattened metal sheet lies flat on the conveying carpet to be moved away from apparatus 10, as shown by arrow VIII, in the direction shown by arrow H.

Hence, the horizontal translation of roller 176 provides for the rigid thick metal sheet 12 to rotate and be removed within its height under control of the rollers 174 and 176.

It should be noted that the distance between the pinch rollers 174 and 176 and the conveying carpet 202 is sufficient to provide for the common edge 28 to engage the carpet 202 as the pinch rollers 174, 176 engage the joined edges 24 and 26 with roller 176 being in the fully forward position.

Having now described an embodiment of the present invention and the operation of this embodiment, other embodiments and features thereof will be herein described to further exemplify the invention and not limit the scope thereof.

In an embodiment, gaps are formed between the upper edges 24 and 26 of the electrodeposited sheets 12 and the cathode 14 by flexing a central portion of the cathode 12 laterally in a first direction to create a gap between an upper edge 24 of an electrodeposited sheet portion 12*a* and the cathode blank face 16 and inserting at finger 92 in this gap, and flexing the cathode 14 laterally in the opposite direction to create a gap between the upper 26 of the other electrodeposited sheet portion 12*b* and the cathode blank face 16 and inserting finger 94 in said gap, and retracting the fingers 92 and 94 from the cathode 14 to strip the electrodeposited sheet portions 12*a* and 12*b* from the cathode. The present invention can also include flexing assemblies as is known in the art.

It should be noted that the type of electro-deposited metal sheets 12 that can be used in the context of the present invention include copper as well as other metals as are commonly used in the art.

The cathode blank 14 in the present invention has been shown to have a generally rectangular shape, yet it should be noted that the skilled artisan may contemplate within the context of the present invention a variety of configurations for cathode blanks.

In the present examples, it was shown that the metal sheet was in a V-like or U-like structure having two portions 12*a* and 12*b* with a common edge 28. Yet it can be contemplated that the cathode 14 is so constructed that in fact the metal sheet 12 is two different sheets, one on each cathode blank face 16 and 18 without a common edge 28. It can also be contemplated that the cathode 14 may be so constructed that there is only one metal sheet 12 on a given face 16 or 18.

The support frame assembly 36 shown in the present description can be contemplated to be constructed in a variety of manners as is known in the art. In one embodiment, which should be taken into account when constructing a frame assembly 36, is to position the in-feed of the cathode blank 14 having a metal sheet 12 electro-deposited thereon, the stripping of the metal sheet 12 from this cathode blank 14 and its controlled feeding by way of the discharge assembly 32 in accordance with the present invention towards an out-feed assembly 34 in a continuous stream. In the examples shown herein, the support frame assembly 36 is so constructed as for the metal sheet 12 to be stripped and then vertically dropped having its drop being controlled by way of the control rollers 174 and 176. Of course, it can be contemplated in the context of the present invention that the assemblies described hereinabove are positioned in a continuous on-line horizontal way rather than having the metal sheet 12 drop after stripping. In the horizontal positioning of the assemblies herein, the control rollers 174 and 176 abut the downstream edge 28 of the metal sheet 12 as it is stripped from the cathode blank 14 so as to immediately feed it towards an out-feed assembly 36.

A variety of stripping assemblies 30 can be contemplated within the scope of the present invention. Of course, stripping assemblies including one stripping member 62 or 64 or one finger 84 and 86 may also be contemplated when the cathode blank 14 includes only one face 16 or 18 having a metal sheet 12 electro-deposited thereon. The stripping assemblies need not include any folding assemblies 136 or hammering assemblies 124 or separating assemblies 100 as disclosed herein. The foregoing are optional features which aid in the stripping of the metal sheet 12 from its cathode blank 14. Nevertheless, a variety of folding assemblies can be contemplated by the skilled artisan as well as various ways of hammering or hitting the metal sheet 12 on the cathode blank 14 so as to loosen it up during stripping. Various other types of separating assemblies including two inclined knives in order to simultaneously cut on each face of the cathode blank 16 and 18 if necessary. Of course members 62 and 64 may be constructed in a variety of suitable ways including various types of finger like or claw like members for stripping metal sheets from cathode blanks.

Various suitable actuators can be used in order to actuate the above-described assemblies.

The discharge assembly 32 need not include a gate assembly 152 but may include a passive guide in order to guide the falling stripped metal sheet 12 towards the area between the pinch rollers 174 and 176. Nevertheless, a variety of gate assemblies 32 can be contemplated by the person having skill in the art.

In fact, the discharge assembly 32 may be an independent assembly that can be mounted to various types of stripping assemblies or stripping apparatuses for controllably moving a metal sheet 12 after it has been stripped towards an out-feed apparatus.

The pinch rollers 174 and 176 of the present invention may be contemplated to be made from a variety of materials suitable for their selected function. The rollers 174 and 176 in the present example were both motorized yet, it can be contemplated in the context of the present invention, to use two spring-loaded rollers that abut each other and hence slow down the drop of the metal sheet 12 therebetween. In another example, only one roller is motorized and the other roller is idle. In still another example, one roller is motorized and the other roller is spring-loaded.

In the example illustrated herein, roller 176 is laterally mobile, the skilled artisan can appreciate that both rollers 174 and 176 may be laterally mobile. Alternatively neither of the rollers 174 and 176 may be laterally mobile.

Rollers 176 need not be mounted to motor that acts on actuator 183 but may spring loaded or use a bushing or biasing member against which the inclining metal sheet 12 whose common edge 28 is dragged away by a conveying carpet 202 may act in order to push roller 176 away from roller 174 making space for the inclining metal sheet to pivot from a vertical position to a horizontal position.

Furthermore, only two rollers 174 and 176 have been illustrated herein, yet two adjacent rows of side by side rollers can also be contemplated with one or more rollers of a given row being motorized and laterally mobile. Moreover the rows of rollers may include a track band mounted thereto.

Rollers 174 and 176 are shown to be rod members having ribs thereon. In other non-illustrated embodiments, the rollers 176 and 176 may be any type of wheel members capable of controllably lowering a metal sheet 12 as describe herein.

The discharge assembly 32 need not include a sensor 199 and hence, the roller 176 may be timed in order to begin to progressively retract as the edge 28 nears the out-feed assembly. In one example, the roller 176 is timed by way of controller 300.

Sensor 199 may be provided in a variety of suitable configurations and can be directly linked to actuating assembly 186 or via controller 300 which can receive data from the sensor and signal the actuating assembly 186 accordingly.

The roller 176 may be returned to it extended position by either a timer or by being signalled by the controller 300.

In another embodiment, a variety of sensors can be positioned at different areas about apparatus 10 in order to detect the position of the metal sheet 12 throughout and send this data to the controller 300 controls the actuation of the various components of apparatus 10 accordingly.

The discharge assembly 32 of the present invention need not include a guide member 157. Hence, the rollers 174 and 176 may feed the strip metal sheet 12 directly on the out-feed assembly without the use of a guide member 157. Nevertheless, a variety of different types of guide members 157 can be contemplated within the scope of the present invention. The length, size and configuration of these guide members 157 is a function of its use and hence depends on the size and material and general configuration of the strip metal sheet 12 that it is guiding towards an out-feed assembly 34.

The out-feed assembly 34 in this example is a conveyor assembly. It should be noted that various types of conveyor assemblies can be used within the scope of the present invention including conveyor assemblies having a carpet 194 with ridges in order to block the metal sheet that is being fed thereon from sliding too quickly on the carpet 194. Hence, as the carpet 194 moves, the downstream edge of the stripped metal sheet abuts this ridge and its sliding descent is controlled.

As aforementioned, the controller 300 may be provided with a variety of sensors in order to receive data on the movement of the cathode blank 14 and metal sheet 12 and hence synchronize the operation of the various components of the apparatus 10, as described herein.

In an embodiment of the present invention, there is provided a single station apparatus in which the in-feed of the cathode with the electro-deposited metal sheet 12 thereon, the stripping of the metal sheet 12 from the cathode blank 14 and its controlled feed towards an out-feed assembly 34 is accomplished at the same station. Furthermore, the hammering, folding and separating of the metal sheet 12 from the cathode blank can also be accomplished at the same station, hence providing a single station apparatus for stripping electro-deposited and metal sheets from permanent cathodes.

In an embodiment of the present invention, there is provided a method for stripping electro-deposited metal sheets 12 from permanent cathodes 14. This method includes positioning the cathode blank 14 including the electro-deposited sheet thereon between a stripping means, which will strip the metal sheet from its upstream edges. In this process, the metal sheet is stabilized by clamps and is hammered in order to cause it to loosen the top edges from the cathode blank. The downstream portions of the metal sheet are cut from the cathode blank and its drop is controlled by a gate means to be led towards a roller means which will controllably feed it to an out-feed means.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. An apparatus for stripping electro-deposited metal sheets from a cathode blank, the blank having opposite faces, and upstream and downstream ends, at least one metal sheet being provided on at least one blank face and having upstream and downstream edges, said apparatus comprising:

a stripping assembly for stripping the metal sheet from the cathode blank;

a discharge assembly positioned downstream of said stripping assembly, said discharge assembly including opposite guide rollers adapted to engage the metal sheet exiting said stripping assembly; and a metal sheet out-feed assembly positioned downstream of said discharge assembly for receiving the metal sheet, the metal sheet out-feed assembly having a receiving end spaced apart from the guide rollers by a distance of less than a height of the stripped metal sheet;

wherein, when the metal sheet has been stripped from the cathode blank, said guide rollers controllably feed the metal sheet towards said out-feed assembly while providing for the stripped metal sheet to rotate within its height.

2. An apparatus according to claim 1, wherein said stripping assembly includes a stripping member having a finger to engage the metal sheet upstream edge.

3. An apparatus according to claim 1, wherein said stripping assembly includes a pair of opposed and spaced apart stripping members defining a cathode blank receiving area therebetween, each of said stripping member including a finger to engage the metal sheet upstream edge when the cathode blank is positioned at said receiving area.

4. An apparatus according to claim 3, wherein said fingers include respective blades for engaging the upstream edges of the metal sheet.

5. An apparatus according to claim 3, wherein said stripping assembly includes a stripping member-actuating assembly.

6. An apparatus according to claim 3, wherein said stripping members are reciprocally mobile.

7. An apparatus according to claim 3, wherein the cathode blank upstream and downstream ends are top and bottom ends respectively and the metal sheet upstream and downstream edges are top and bottom edges respectively.

8. An apparatus according to claim 1, wherein said stripping assembly includes a separating assembly for separating unstripped portion of the metal sheet from the cathode.

9. An apparatus according to claim 8, wherein said separating assembly includes a mobile knife member for cutting between the metal sheet and the cathode blank from a stripped portion of the metal sheet towards the downstream edge of the metal sheet.

10. An apparatus according to claim 1, wherein said stripping assembly includes a hammering assembly for loosening the upstream edges of metal sheet from the cathode blank.

11. An apparatus according to claim 10, wherein said hammering assembly includes an air hammer.

12. An apparatus according to claim 10, wherein said hammering assembly includes opposite spaced apart air hammers.

13. An apparatus according to claim 1, wherein said stripping assembly includes a folding assembly for folding opposite portions of the stripped metal sheet together.

14. An apparatus according to claim 13, wherein said folding assembly includes two opposite spaced apart folding members.

15. An apparatus according to claim 14, wherein said folding members are reciprocally mobile.

16. An apparatus according to claim 14, wherein said folding members include a roller for engaging the metal sheet.

17. An apparatus according to claim 1, wherein said guide rollers are spring loaded.

18. An apparatus according to claim 1, wherein said guide rollers are motorized.

19. An apparatus according to claim 16, wherein said guide rollers are linked to a speed controller.

20. An apparatus according to claim 1, wherein at least one guide roller is motorized.

21. An apparatus according to claim 20, wherein the other of said guide rollers is idle.

22. An apparatus according to claim 20, wherein the other of said guide rollers is spring loaded.

23. An apparatus according to claim 20, wherein said motorized guide roller is linked to a controller.

24. An apparatus according to claim 1, wherein at least one of said rollers is laterally mobile.

25. An apparatus according to claim 24, wherein said at least one laterally mobile roller is mounted to an actuator for lateral movement thereof.

26. An apparatus according to claim 25, wherein said rollers are mounted to a base, said actuator being mounted to a panel member slidably mounted to said base member, said panel member being mounted to said laterally mobile roller.

27. An apparatus according to claim 26, wherein said laterally mobile roller is mounted at its longitudinal ends to brackets, said brackets being mounted to said panel.

28. An apparatus according to claim 24 wherein said actuator includes biasing member.

29. An apparatus according to claim 28, wherein said biasing member is a spring.

30. An apparatus according to claim 29, wherein said biasing member is a bushing.

31. An apparatus according to claim 25, wherein said discharge assembly includes a sensor so positioned as to detect the metal sheet nearing the out-feed assembly.

32. An apparatus according to claim 31, wherein said sensor signals said actuator so as to laterally move said laterally mobile roller.

33. An apparatus according to claim 31, wherein said sensor is linked to a controller so as to send data thereto.

34. An apparatus according to claim 33, wherein said controller signals said actuator so as to laterally move said laterally mobile roller.

35. An apparatus according to claim 1, wherein two metal sheets are respectively provided on each of the blank faces, the downstream edges of both metal sheets defining a common edge, said guide rollers adapted to engage the common edge when the metal sheets are exiting said stripping assembly.

36. An apparatus according to claim 35, wherein said guide rollers are adapted to flatten the two metal sheets together when feeding the metal sheets to said out-feed assembly.

37. An apparatus according to claim 35, wherein the respective upstream edges of the two metal sheets are top edges and the common edge is a bottom edge, said guide rollers being positioned below said stripping assembly.

38. An apparatus according to claim 1, wherein said discharge assembly is positioned below said stripping assembly.

39. An apparatus according to claim 1, wherein said discharge assembly further includes a guide member downstream of said guide rollers, said metal sheet being fed to said out-feed assembly via said guide member.

40. An apparatus according to claim 39, wherein said guide member is positioned below said guide rollers, said out-feed assembly being positioned below said guide member, said guide rollers controllably lowering the metal sheet onto said out-feed assembly via said guide member.

41. An apparatus according to claim 40, wherein the metal sheet slides along the guide member onto the out-feed assembly.

42. An apparatus according to claim 1, wherein said out-feed assembly is positioned below said discharge assembly, said guide rollers being adapted for controllably lowering said sheet member onto said out-feed assembly.

43. An apparatus according to claim 1, wherein said out-feed assembly is a conveyor assembly.

44. An apparatus according to claim 43, wherein said conveyor assembly includes opposite rollers and a conveying carpet mounted thereto.

45. An apparatus according to claim 1, further comprising a cathode blank in-feed assembly upstream of said stripping assembly for moving the cathode blank to said stripping assembly.

46. An apparatus according to claim 45, wherein said cathode blank in-feed assembly includes a cathode-carrying member engaging the upstream end of the cathode blank.

47. An apparatus according to claim 46 wherein the cathode blank upstream and downstream ends are top and bottom ends respectively.

48. An apparatus according to claim 47, wherein said cathode blank in-feed assembly is positioned above said stripping assembly.

49. An apparatus according to claim 45, wherein said cathode blank in-feed assembly is a conveyor assembly, said cathode hanging from said cathode-carrying member.

50. A discharge assembly for an apparatus for stripping electro-deposited metal sheets from a cathode blank, the apparatus including a metal sheet stripping assembly adapted to be positioned upstream of the discharge assembly and a metal sheet out-feed assembly adapted to be positioned downstream of the stripping assembly, said discharge assembly comprising:

opposite guide rollers adapted to engage the metal sheet exiting the stripping assembly, the metal sheet out-feed assembly having a receiving end spaced apart from the guide rollers by a distance of less than a height of the stripped metal sheet, whereby once the metal sheet has been stripped from the cathode blank, said guide rollers controllably feed the metal sheet towards the out-feed assembly while providing for the stripped metal sheet to rotate within its height.

51. An apparatus according to claim 50, wherein said guide rollers are spring loaded.

52. An apparatus according to claim 50, wherein said guide rollers are motorized.

53. An apparatus according to claim 52, wherein said guide rollers are linked to a controller.

54. An apparatus according to claim 50, wherein at least one guide roller is motorized.

55. An apparatus according to claim 54, wherein the other of said guide rollers is idle.

56. An apparatus according to claim 54, wherein the other of said guide rollers is spring loaded.

57. An apparatus according to claim 54, wherein said motorized guide roller is linked to a controller.

58. An apparatus according to claim 50, wherein at least one of said rollers is laterally mobile.

59. An apparatus according to claim 58, wherein said at least one laterally mobile roller is mounted to an actuator for lateral movement thereof.

60. An apparatus according to claim 59, wherein said rollers are mounted to a base, said actuator being mounted to a panel member slidably mounted to said base member, said panel being mounted to said laterally mobile roller.

61. An apparatus according to claim 60, wherein said laterally mobile roller is mounted at its longitudinal ends to brackets said brackets being mounted to said panel.

62. An apparatus according to claim 59 wherein said actuator includes biasing member.

63. An apparatus according to claim 62, wherein said biasing member is a spring.

64. An apparatus according to claim 63, wherein said biasing member is a bushing.

65. An apparatus according to claim 59, wherein said discharge assembly includes a sensor so positioned as to detect the metal sheet nearing the out-feed assembly.

66. An apparatus according to claim 65, wherein said sensor signals said actuator so as to laterally move said laterally mobile roller.

67. An apparatus according to claim 65, wherein said sensor is linked to a controller so as to send data thereto.

68. An apparatus according to claim 67, wherein said controller signals said actuator so as to laterally move said laterally mobile roller.

69. A single-station apparatus for stripping electro-deposited metal sheets from a cathode blank, the blank having opposite faces, upstream and downstream ends, at least one metal sheet being provided on at least one blank face and having upstream and downstream edges, said apparatus comprising:

an in-feed assembly;

a stripping assembly positioned downstream of said in-feed assembly for stripping the metal sheet from the cathode blank and including:

a hammering assembly for loosening the upstream edges of the metal sheets; and a separating assembly for separating unstripped portions of the metal sheet from the cathode blank;

a discharge assembly positioned downstream of said stripping assembly, said discharge assembly including opposite guide rollers adapted to engage the metal sheet exiting said stripping assembly; and a metal sheet out-feed assembly positioned downstream said discharge assembly for receiving the metal sheet, the metal sheet out-feed assembly having a receiving end spaced apart from the guide rollers by a distance of less than a height of the stripped metal sheet;

wherein, the in-feeding, stripping, hammering, separating, discharge and out-feed of the metal sheet is effected in a single continuous station, and said guide rollers controllably feed the metal sheet towards said out-feed assembly while providing for the metal sheet to rotate within its height.

70. An apparatus according to claim 69, wherein at least one of said rollers is laterally mobile.

71. An apparatus according to claim 70, wherein said at least one laterally mobile roller is mounted to an actuator for lateral movement thereof.

72. A single-station apparatus according to claim 69, wherein two metal sheets are respectively provided on each of the blank faces, the downstream edges of both metal sheets defining a common edge, said discharge assembly further including a folding assembly adapted to fold the two stripped metal sheets together.

* * * * *